US006289824B1

(12) United States Patent
Parker et al.

(10) Patent No.: US 6,289,824 B1
(45) Date of Patent: Sep. 18, 2001

(54) COLLAPSIBLE JOBSITE PLAN TABLE

(75) Inventors: Paul Oliver Parker, 682 Pine Level-Micro Rd., Selma, NC (US) 27576; Neil Martin Wilks, 5324 Bartram Pl., Raleigh, NC (US) 27613

(73) Assignees: Paul Oliver Parker; Neil Martin Wilks, both of Selma, NC (US)

( * ) Notice: Subject to any disclaimer, the term of this patent is extended or adjusted under 35 U.S.C. 154(b) by 0 days.

(21) Appl. No.: 09/550,636

(22) Filed: Apr. 17, 2000

(51) Int. Cl.[7] ..... A47B 3/00
(52) U.S. Cl. ..... 108/115; 108/35
(58) Field of Search ..... 108/115, 35, 38, 108/34, 36, 33, 39, 65, 69, 125

(56) References Cited

U.S. PATENT DOCUMENTS 1,063,642 * 6/1913 Birdsall ..... 108/36
2,292,797 * 8/1942 Roberts ..... 108/33 X
2,508,627 * 5/1950 Spiegel et al. ..... 108/36 X
4,927,128 * 5/1990 O'Brian ..... 108/36 X
5,660,117 * 8/1997 Noble ..... 108/35
5,819,671 * 10/1998 Ocampo ..... 108/65 X
6,079,338 * 6/2000 Yeh ..... 108/34 X
6,161,486 * 12/2000 Boots ..... 108/33 X

FOREIGN PATENT DOCUMENTS

48762 * 3/1911 (AT) ..... 108/36

* cited by examiner

*Primary Examiner*—José V. Chen

(57) ABSTRACT

A collapsible jobsite plan table including two horizontally slideable, tubular surfaces containing pre-molded guide stiffeners on the underside of table, to ensure balanced telescoping action and rigidity. The tables collapsible distance can be adjusted by placing surface adjustment lock bolt in one of the desired, various pre-drilled holes on table edges. A plan lip or stop is located at the bottom edge of the table surface to ensure documents remain on the table. The table contains four support legs, adjustable to allow table surface to be adapted to individuals height and also allowing for tiltable surface for viewing documents. The legs contain numerous holes allowing for these adjustments. Anchor feet located on the bottom of individual legs allow table to be anchored to any surface encountered. The table is easily collapsible and legs fold under the table allowing for quick and easy transportation without need of tools. The entire table assembly is made of all-weather and lightweight materials.

2 Claims, 5 Drawing Sheets

COLLAPSIBLE JOBSITE PLAN TABLE

BACKGROUND OF THE INVENTION

The present invention relates to plan review tables, and more particularly those that are for all weather use and collapsible for easy transportation.

SUMMARY OF THE INVENTION

Accordingly, a primary object of the present invention is to provide an adjustable and collapsible table made of durable plastic or other lightweight materials that can be used in an all weather type environment and is practical.

It is a more specific object of the invention to provide a collapsible table surface which includes two horizontally slidably connected, tubular type surfaces which contain pre-molded guide/stiffeners to ensure rigidity and strategically placed alignment holes on the top and bottom edge of the table surface to obtain various open and closed positions. The top surface has a plan lip or stop to ensure that the blueprints remain on the table during reviewing. One outer edge of the table has a handle for transportation when collapsed.

The legs also are comprised of two vertically tubular type surfaces containing numerous pre-drilled holes which allow various heights and angles to be obtained easily for each individuals independent height requirements. The legs are foldable by use of extruded pins protruding from the upper leg into molded support blocks creating a pivot point. The legs are locked in the open and collapsed position by lock out bolts placed through pre-drilled holes on the molded support blocks. In addition, each leg has an anchor foot plate, that can be fastened to any surface through pre-drilled holes.

It is further object of the present invention to provide a versatile, lightweight, durable and economical blueprint review table for construction superindentents, Forman, engineers, architects and the like to use in any weather environment that is quick and easy to transport.

More objects of the present invention will become obvious as drawings and detailed description to follow are reviewed with drawing reference numbers that correspond.

DETAILED DESCRIPTION OF THE INVENTION

Figure 1:
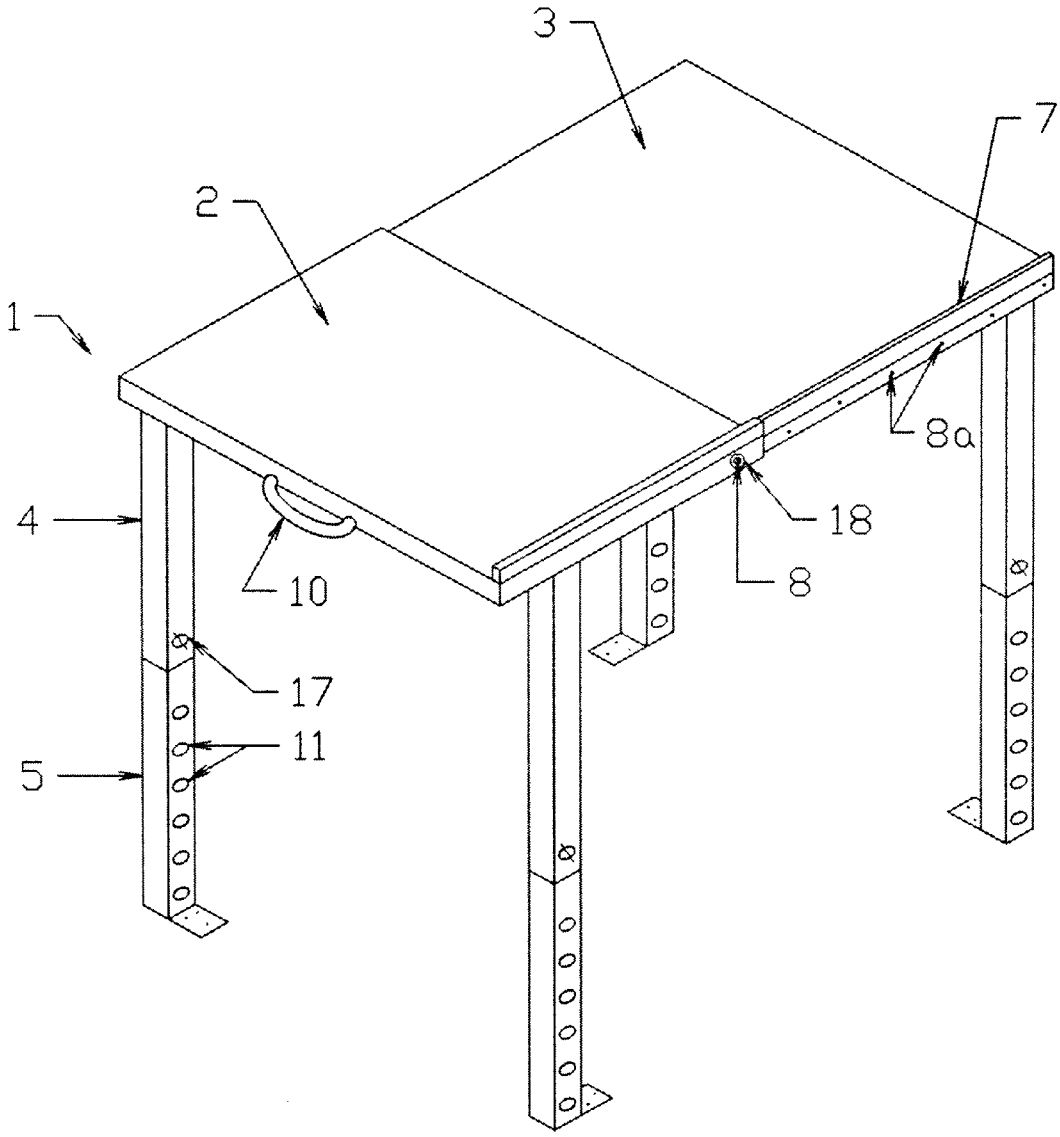
FIG. 1 is a perspective view of the collapsible jobsite plan table according to the invention.

FIG. 1 shows a collapsible jobsite plan table designated by the numeral 1 used to support architectural blueprints and other miscellaneous documents. The table consists of a outer planer panel 2, an inner planer panel 3, four adjustable support legs 4 and 5, leg anchor plate 6, and the carrying handle 10.

Figure 2:
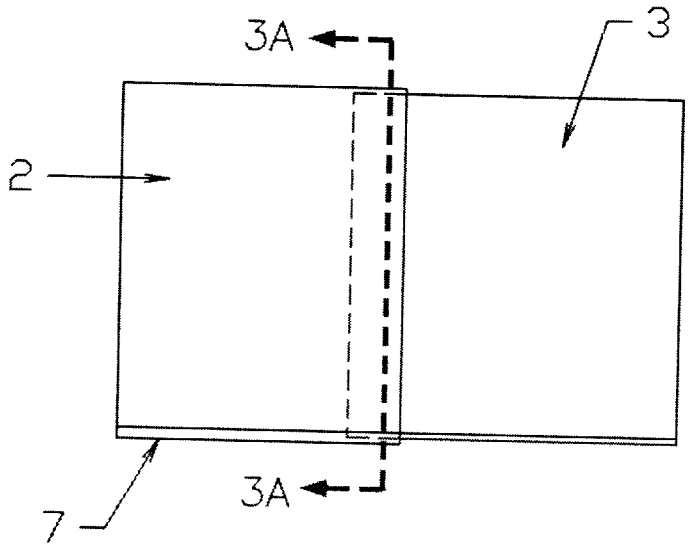
FIG. 2 is a top plan view showing the inner and outer planer surfaces.
Figure 3A:
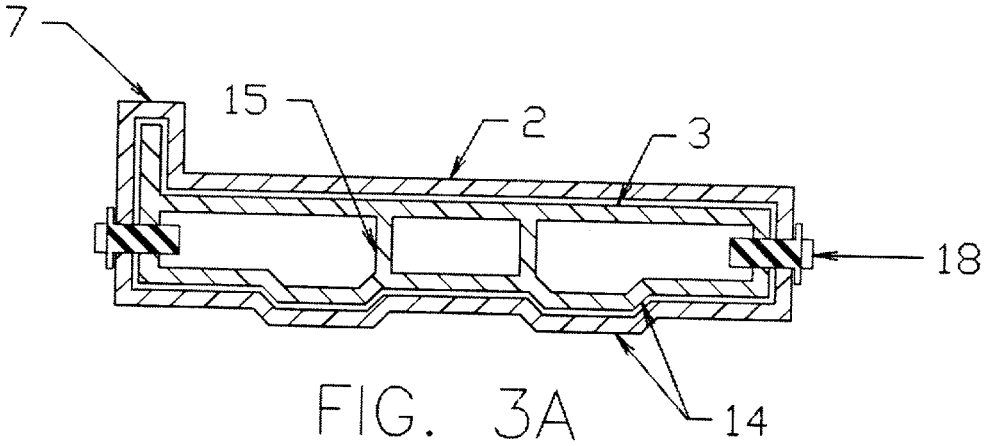
FIG. 3A is a sectional end view of the inside of the planer surfaces taken along line 3A—3A of FIG. 2.

Referring now to FIGS. 2 and 3A, it will be seen that the inner planer panel 3 collapses into the outer panel 2. The two panels 2 and 3 are collapsed uniformly using guide stiffener ribs 14. The inner panel 3 has stiffener ribs 15 running vertical to enhance the rigidity of the panel. The outer panel 2 and inner panel 3 also have a collapsible plan lip 7 which, collapses uniformly with the planer table surfaces, to ensure that blueprints, pencils, etc. remain on the table.

Figure 3B:
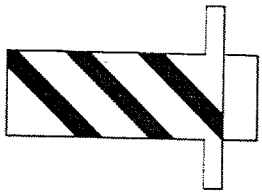
FIG. 3B is a plan view of the surface adjustment lock screw.
Figure 3C:
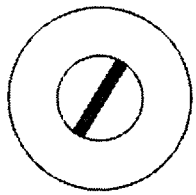
FIG. 3C is a end view of the surface adjustment lock screw.

FIG. 3B shows a side view and FIG. 3C shows a end view of the surface adjustment lock screw 18. These are best shown in FIG. 3A to secure the outer panel 2 and the inner panel 3 in the open position. This is accomplished by placing surface adjustment lock screw 18 in the pre-drilled hole 8 on the outside edge of the outer panel 2 and simply twisting it into one of the pre-drilled holes 8*a* in the inner panel 3 to obtain various width requirements. The pre drilled holes 8 and 8*a* are best viewed in FIG. 1. This will take place on the opposite side of the table as well.

In addition there exists the same situation when the plan table 1 is collapsed. When the collapsible jobsite plan table 1 is in the closed position, the last pre-drilled hole 8*a* on the inner surface panel 3 will line up with hole 8 on the outer surface panel 2, and, the surface adjustment lock screw 18 can be used to secure the table in the closed position for easy compact transportation by use of the carrying handle 10 located on the end of outer planer surface panel 2.

Figure 4:
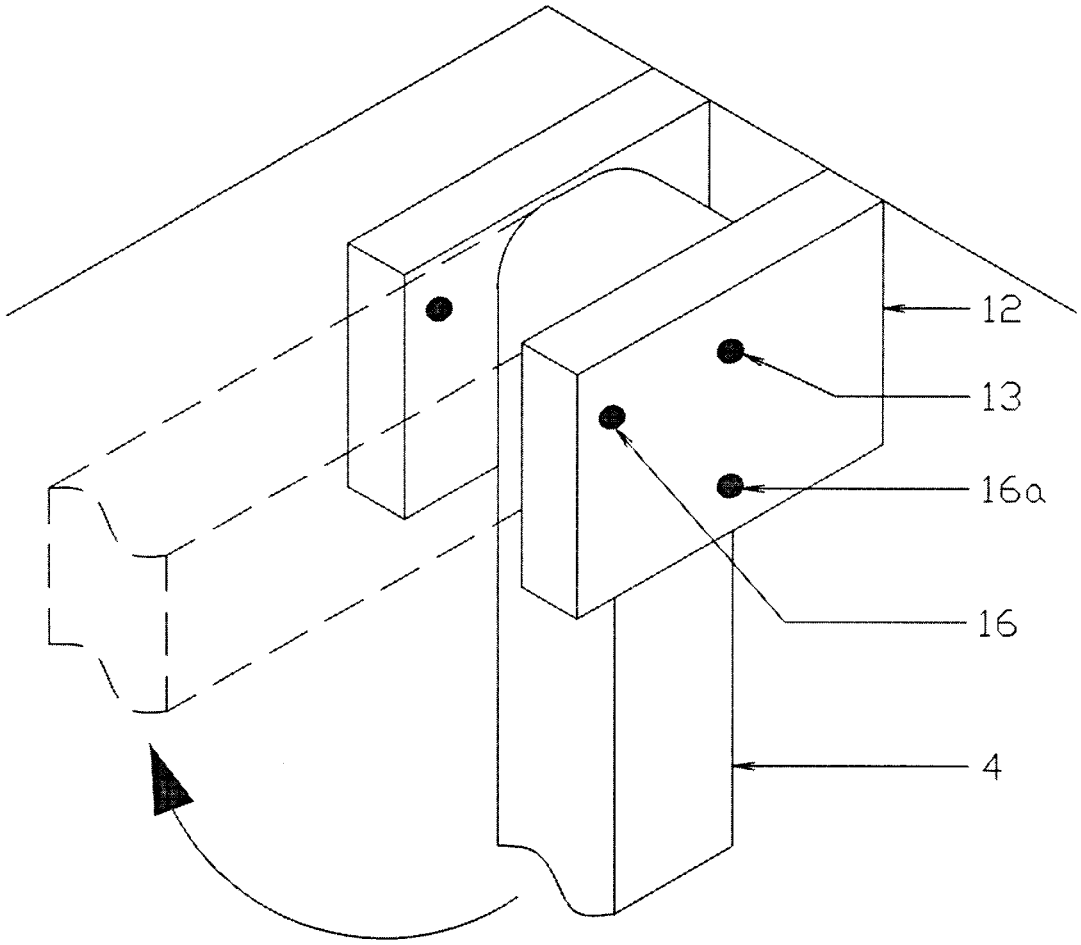
FIG. 4 is a perspective view of a portion of a leg member.

The adjustable legs consist of an upper leg panel 4 and a lower leg panel 5, which can best be viewed in FIG. 1 and FIG. 4. In FIG. 4, the legs are attached to planer surfaces 2 and 3 by molded support blocks 12. The outer leg 4 pivots on extruded pins 13 protruding from two sides of each outer leg panel 4 into molded support blocks 12. The outer leg panel 4 is secured in the open position by the lock out bolt 17 into receiver hole 16 of molded support block 12. The lock out bolt 17 is again used to secure the outer leg panel 4 in the collapsed position into receiver hole 16*a* of molded support block 12. Furthermore, FIG. 1 shows the leg consists of an inner panel 5, which adjusts up and down in the outer leg panel 4 to achieve various height requirements and is secured in one of the numerous pre-drilled holes 11 by the lock out bolt 17 shown in FIG. 5. In FIG. 1 also shown is the leg anchor plates 6 with numerous holes used in anchoring the table to any surface.

Figure 5:
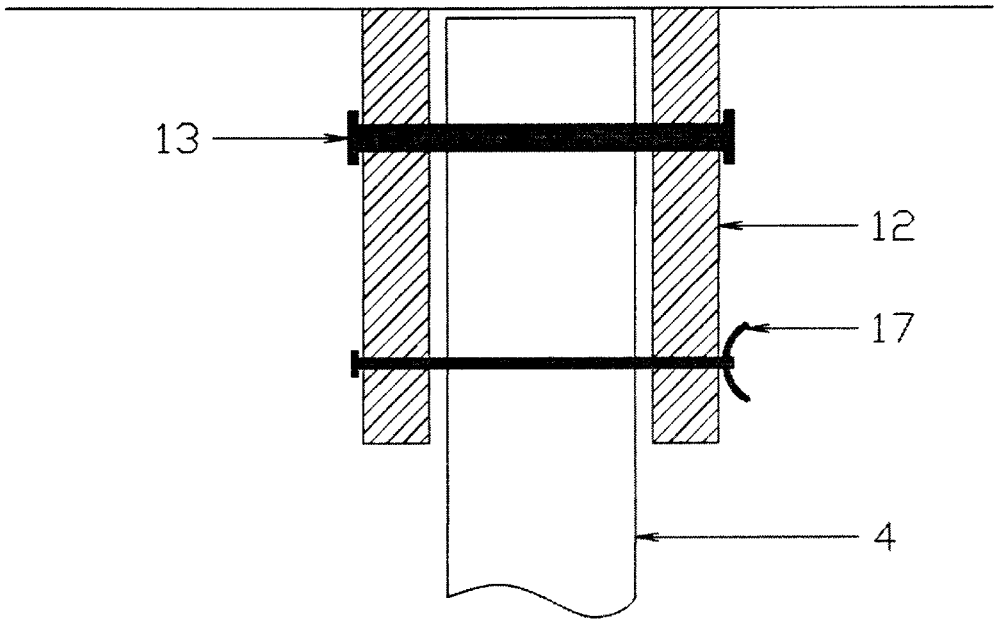
FIG. 5 is perspective view of a leg pin and attachment mechanism.
Figure 5A:
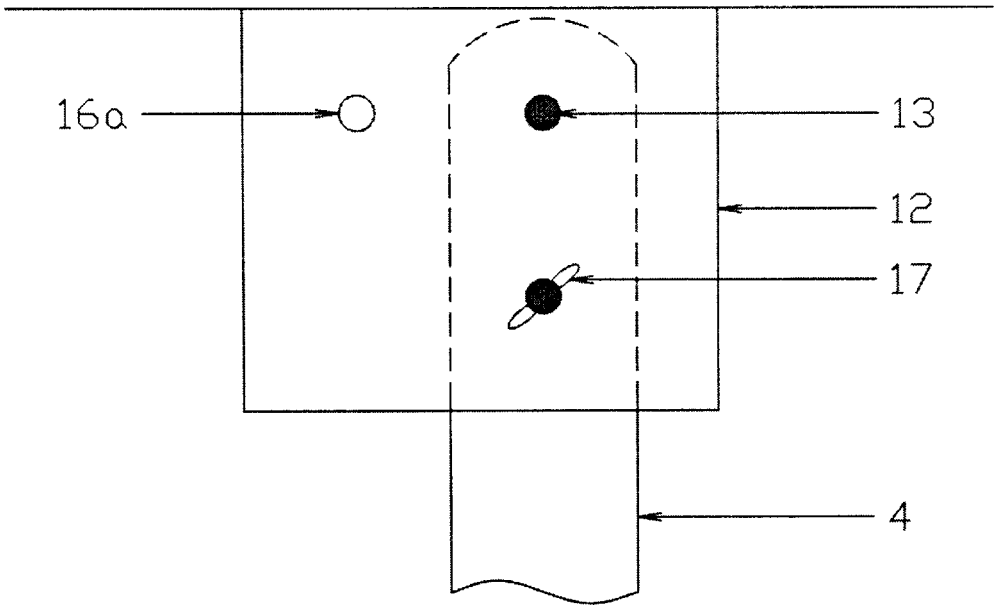
FIG. 5A is a side view of the leg pin and attachment mechanism.

FIG. 5 and FIG. 5A show a sectional views which, further illustrate how the upper leg 4 is connected to table 1 and molded support blocks 12. The lock out bolt 17 is shown inserted into the molded support blocks 12 through pre-drilled hole 16.

Figure 6:
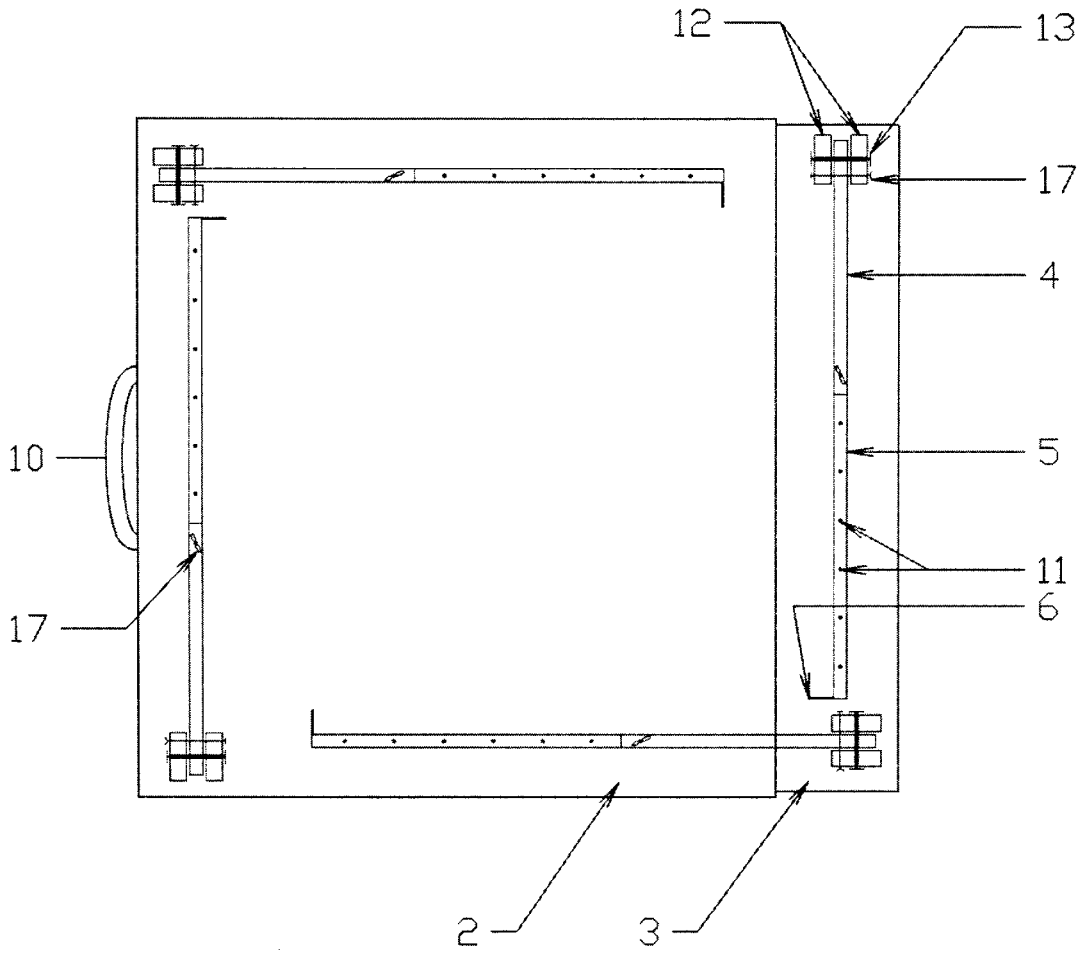
FIG. 6 is a bottom plan view of the table showing the underside with adjustable legs folded underneath.

Now referring to FIG. 6 the bottom view of the jobsite plan table 1 is shown in the collapsed position. As shown the legs are secured in the closed position by the lock out bolt 17 placed through receiver hole 16*a* of the molded support block 12. The table 1 is now ready for easy compact transportation.

While in accordance with the Patent Statutes provisions the preferred forms and embodiments of the invention have been illustrated and described. It will apparent to those of ordinary skill in the art from the preceding drawings and accompanying description that various modifications and changes may be made without deviating from the inventive concepts set forth above.

What we claim is:

1. A collapsible jobsite plan table, comprising:

(a) a planer table top surface, said planer table top including (1) a outer tubular panel with guide stiffener ribs or channels molded into underside of outer panel;

(2) a inner tubular panel fractionally smaller, interconnected with said outer panel by guide stiffener ribs molded into underside of inner panel thus allowing said inner panel to be telescopically received into and extendible from said outer panel, said inner panel also contains vertical support ribs to ensure rigidity; and (3) at least one carrying handle attached to end of inner or outer planer panel;

each said planer table top surface contains a plan lip or stop located on the bottom top edge, rectangular in shape, with the outer panel plan lip being slightly larger than the inner panel plan lip allowing said inner panel plan lip to be telescopically received into the said outer panel plan lip, thus allowing for collapsibility of the table assembly;

each said planer table top surface further contains various alignment holes on the top edge and bottom edge of the table, used to lock the said inner tubular panel and outer tubular panel in collapsed or various open positions;

(b) leg support assembly members arranged on the underside of said outer and inner tubular panels, said leg support assembly members include (1) a upper leg support member;

(2) a lower or inner leg support member telescopically received into said upper leg support member, whereby allowing said leg support assemblies to adjust in height; also allowed is angle adjustment for the said table top surface if required during viewing by telescopically extending or collapsing the said inner leg support members at the rear of the said planer table top surface into said upper leg support member;

(3) molded mounting support blocks; and (4) anchor feet plate with numerous holes, thereby allowing said leg support assembly to be secured to any surface;

each said upper leg support member is connected to underside of said outer and inner tubular panels by connector pins protruding from the sides at the top, whereby the said connector pins are engaged with molded mounting support blocks which serve as connecting points and pivot points for said leg support members, said mounting support blocks have receiver holes strategically placed on blocks whereby allowing legs to be placed in an open or closed position.

2. The table apparatus recited in claim 1, wherein said collapsible jobsite plan table entire assembly is made of all-weather, light-weight materials allowing for various uses and transportation.

* * * * *